US005318439A

United States Patent [19]

Sigler

[11] Patent Number: 5,318,439

[45] Date of Patent: Jun. 7, 1994

[54] JET BURNER CONSTRUCTION HEATING APPARATUS UTILIZING THE JET BURNER CONSTRUCTION AND METHODS OF MAKING THE SAME

[75] Inventor: Kent K. Sigler, Youngwood, Pa.

[73] Assignee: Robertshaw Controls Company, Richmond, Va.

[21] Appl. No.: 12,886

[22] Filed: Feb. 3, 1993

[51] Int. Cl.[5] ..... F23D 14/58

[52] U.S. Cl. ..... 431/286; 29/890.01; 29/428; 431/354

[58] Field of Search ..... 431/286, 354, 191; 29/890.01, 428

[56] References Cited

U.S. PATENT DOCUMENTS

| | | | |
|---|---|---|---|
| 1,424,739 | 8/1922 | Reeves . | |
| 2,670,790 | 3/1954 | Marble | 431/286 X |
| 2,875,821 | 3/1959 | Allen | 431/286 |
| 3,198,238 | 8/1965 | Hughes | 431/286 X |
| 4,179,261 | 12/1979 | Riehl | 431/286 |
| 5,035,609 | 7/1991 | Riehl | 431/286 |
| 5,131,839 | 7/1992 | Riehl | 431/286 |
| 5,186,620 | 2/1993 | Hollingshead | 431/286 X |
| 5,188,526 | 2/1993 | Riehl | 431/286 |

*Primary Examiner*—Carl D. Price

*Attorney, Agent, or Firm*—Candor, Candor & Tassone

[57] ABSTRACT

A jet burner construction, a heating apparatus utilizing the jet burner construction and methods of making the same are provided, the jet burner construction having wing-like extensions respectively disposed on opposite sides of the burner body thereof for respectively interconnecting with adjacent wing-like extensions of adjacent burner constructions, each wing-like extension having a side edge and an elongated outlet slot extending along the side edge thereof and interconnected with an outlet opening of the burner body through which fuel is adapted to issue so as to burn external to the wing-like extensions, each slot having a certain height throughout the elongated length thereof, each wing-like extension having a chamber therein that interconnects with the chamber of the burner body and is adapted to feed fuel from the chamber to the respective slot thereof along a major portion of the elongated length thereof, each chamber of each wing-like extension having a height throughout the entire area thereof that is substantially the same as the certain height of its respective slot except for a section thereof that has a height thereof that is greater than the certain height with each section having opposed ends one of which is interconnected to the chamber of the burner body and the other of which terminates short of its respective slot.

18 Claims, 4 Drawing Sheets

JET BURNER CONSTRUCTION HEATING APPARATUS UTILIZING THE JET BURNER CONSTRUCTION AND METHODS OF MAKING THE SAME

BACKGROUND OF THE INVENTION

1. Field of the Invention

This invention relates to a new burner construction and to a new heating apparatus utilizing such a burner construction as well as to new methods of making such a burner construction and such a heating apparatus.

2. Prior Art Statement

It is known to provide a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner body means having wing-like extensions respectively disposed on opposite sides thereof for respectively interconnecting with adjacent wing-like extensions of adjacent burner constructions, the wing-like extensions each having a side edge means and an elongated outlet slot means extending along the side edge means thereof and interconnecting with the outlet opening means and through which fuel is adapted to issue so as to burn external to the wing-like extensions, each said slot means having a certain height throughout the elongated length thereof, each wing-like extension having a chamber therein that interconnects with the chamber means of the body means and is adapted to feed fuel from the chamber means to the respective slot means thereof along a major portion of the elongated length thereof, each chamber having a height throughout the entire area thereof that is greater than the certain height of its respective slot means. For example, see the U.S. Pat. No. 5,131,839, to Riehl.

Also see the U.S. Pat. No. 5,035,609, to Riehl, wherein the entire height of the chamber of each wing-like extension is the same as the certain height of the respective slot means.

SUMMARY OF THE INVENTION

It is one of the features of this invention to provide a new jet burner construction that has unique means for feeding fuel to the elongated outlet slot means of each of the wing-like extensions thereof so as to provide for full carry-over flames throughout the entire elongated length thereof.

In particular, it was found according to the teachings of this invention that a section of each chamber in each wing-like extension can have a height thereof that is greater than the height of the remainder of that chamber and can be directed toward the outer free end of its respective wing-like extension so that sufficient fuel will be directed to the outer portion of the elongated slot means of that respective wing-like extension for full carry-over flame means throughout the entire elongated length of the respective slot means.

For example, one embodiment of this invention comprises a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner body means having wing-like extensions respectively disposed on opposite sides thereof for respectively interconnecting with adjacent wing-like extensions of adjacent burner constructions, the wing-like extensions each having a side edge means and an elongated outlet slot means extending along the side edge means thereof and interconnecting with the outlet opening means and through which fuel is adapted to issue so as to burn external to the wing-like extensions, each slot means having a certain height throughout the elongated length thereof, each wing-like extension having a chamber therein that interconnects with the chamber means of the body means and is adapted to feed fuel from the chamber means to the respective slot means thereof along a major portion of the elongated length thereof, each chamber having a height throughout the entire area thereof that is substantially the same as the certain height of its respective slot means except for a section thereof that has a height thereof that is greater than the certain height, each section having opposed ends one of which is interconnected to the chamber means and the other of which terminates short of its respective slot means.

Accordingly, it is an object of this invention to provide a new jet burner construction having one or more of the novel features of this invention as set forth above or hereinafter shown or described.

Another object of this invention is to provide a new method of making such a jet burner construction, the method of this invention having one or more of the novel features of this invention as set forth above or hereinafter shown or described.

Another object of this invention is to provide a new heating apparatus utilizing a jet burner construction, the heating apparatus of this invention having one or more of the novel features of this invention as set forth above or hereinafter shown or described.

Another object of this invention is to provide a new method of making such a heating apparatus, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
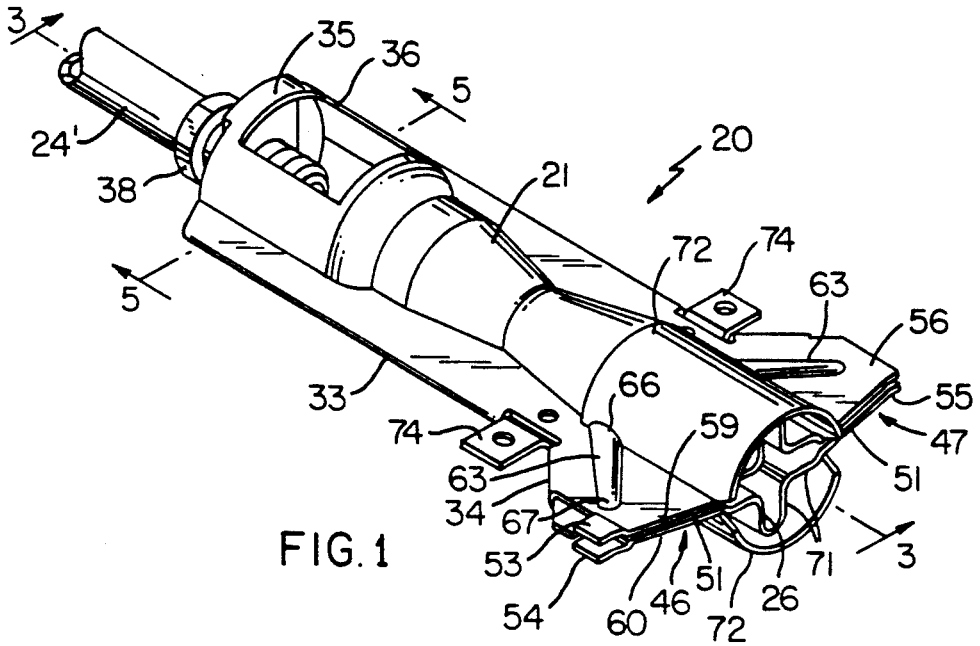
FIG. 1 is a perspective view of the new jet burner construction of this invention.

While the various features of this invention are hereinafter illustrated and described as being particularly adapted to provide a burner construction for a jet burner construction application thereof, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

Figure 2:
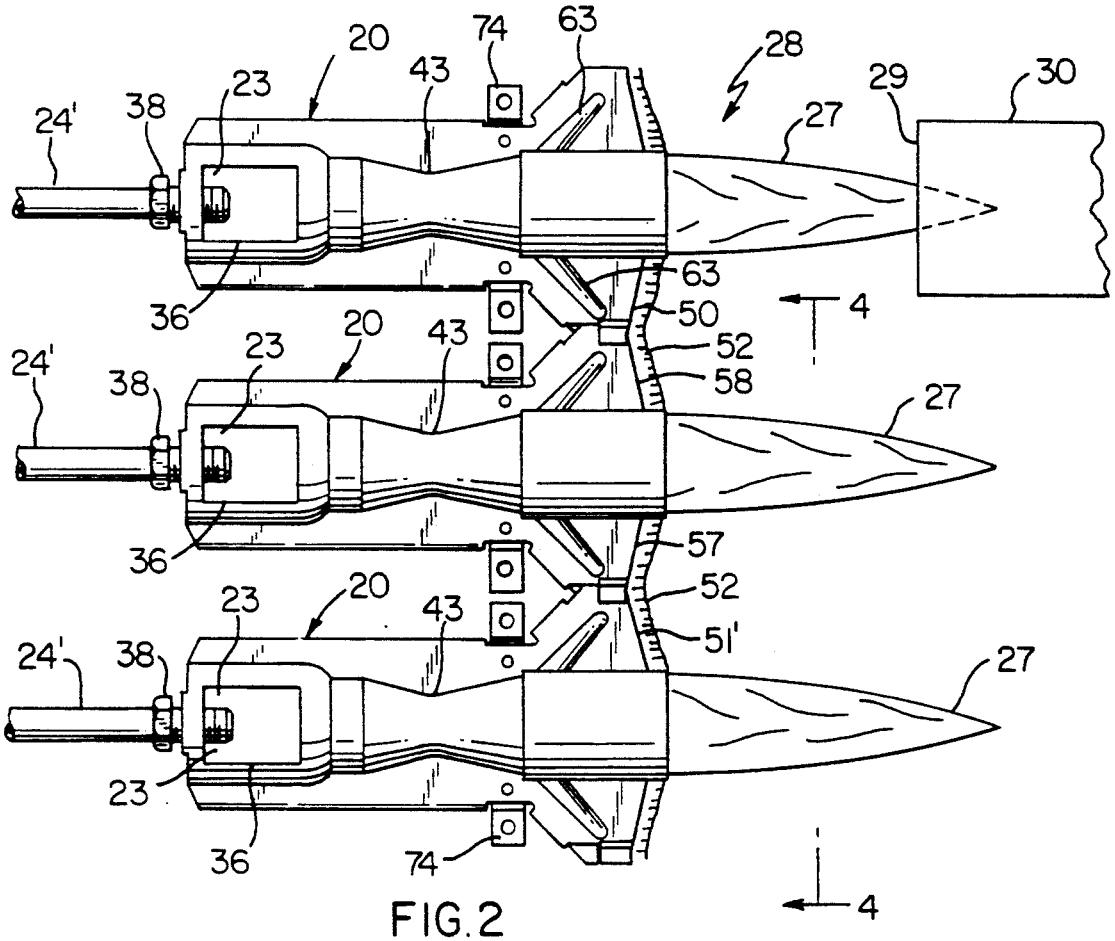
FIG. 2 is a fragmentary top view of a plurality of the jet burner construction of FIG. 1 arranged in a heating apparatus of this invention.
Figure 3:
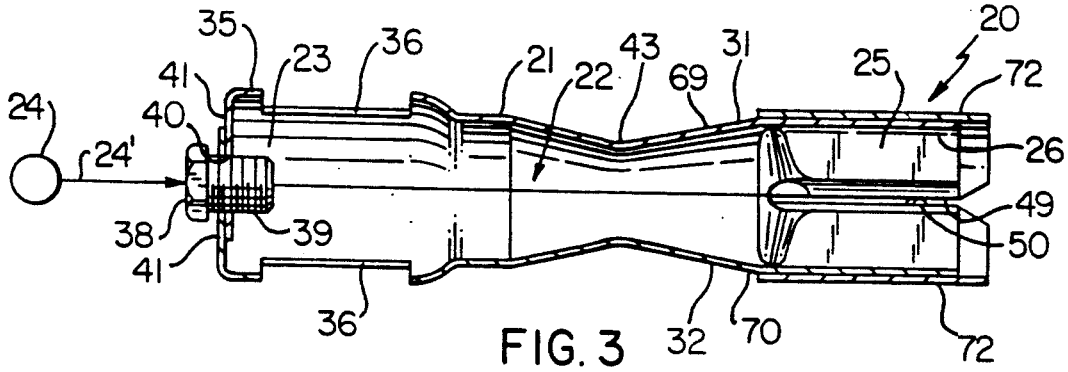
FIG. 3 is a cross-sectional view taken on line 3—3 of FIG. 1.

Referring now to FIGS. 1, 2 and 3, the new jet burner construction of this invention is generally indicated by the reference numeral 20 and comprises a burner body means 21 having a chamber means 22 therein and having an inlet means 23 leading to the chamber means 22 for directing fuel, such as a natural or synthetic gas, from a fuel source 24 and an outlet means 25 leading from the chamber means 22 and defining an outlet opening means 26 through which the fuel is adapted to issue from the chamber means 22 to burn externally to the burner body means 21 as illustrated by the flames 27 in FIG. 2.

Figure 4:
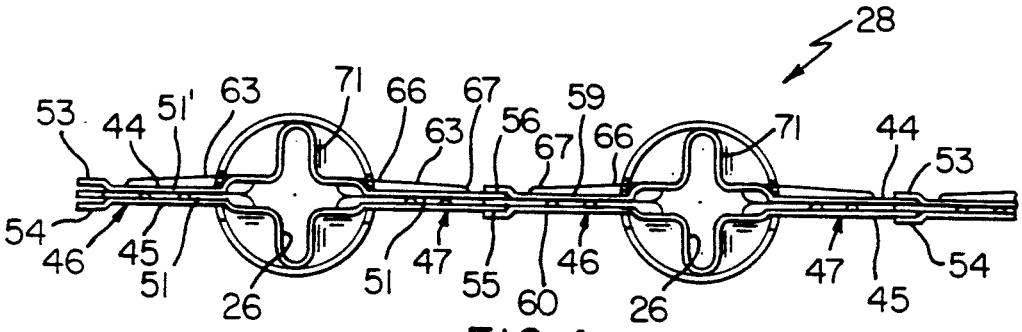
FIG. 4 is a fragmentary end view taken in the direction of the arrows 4—4 of FIG. 2 and illustrates the outlet ends of two of the jet burner constructions of this invention without having the fuel burning at the outlet ends thereof as illustrated in FIG. 2.
Figure 5:
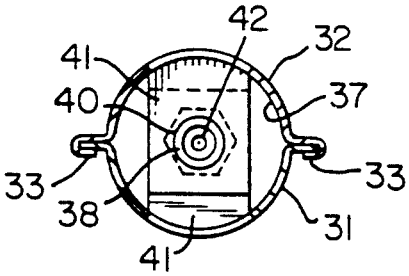
FIG. 5 is a cross-sectional view taken on line 5—5 of FIG. 1.

The jet burner construction 20 of this invention is adapted to be arranged in a side-by-side aligned relation with a plurality of other jet burner constructions 20 of this invention in the manner illustrated in FIGS. 2 and 4 to be utilized in a heating apparatus of this invention that is generally indicated by the reference numeral 28 in FIG. 2 wherein each jet burner construction 20 is adapted to direct its flame 27 into an inlet end 29 of a heat tube arrangement 30 which extracts heat from the flame 27 in an efficient manner that is well known in the art. For example, see the Bryant Formula 1,000 heating apparatus of the Carrier Corporation of Syracuse, N.Y. Therefore, the details of the structure and the operation of the heating apparatus 28 need not be set forth.

Also, the burner construction 20 and the apparatus 28 of this invention are generally the same as the burner constructions and apparatus of the aforementioned U.S. Pat. Nos. 5,035,609 and 5,131,839, to Riehl, whereby these two U.S. patents are being incorporated into this disclosure by this reference thereto.

However, it is to be understood that in FIGS. 1–11 of this application, the burner constructions 20 and 20A are each shown with one side thereof being the top side of that burner construction whereas it is presently preferred that the other side thereof be the top side of the burner construction in the application thereof in the heating apparatus 28 but for the purpose of illustrating the improved features of this invention, it was deemed best to illustrate the burner construction with its normally down side being illustrated as the top side of the burner construction. Of course, it is believed that either of the burner constructions of this invention will operate in substantially the same manner regardless of which side thereof is the top side thereof.

Figure 6:
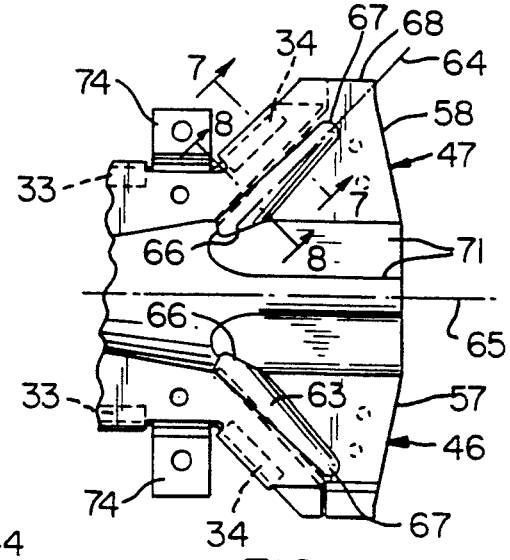
FIG. 6 is an enlarged fragmentary view of the outlet end of the burner construction of FIG. 1 with its respective flame shield means removed therefrom.
Figure 9:
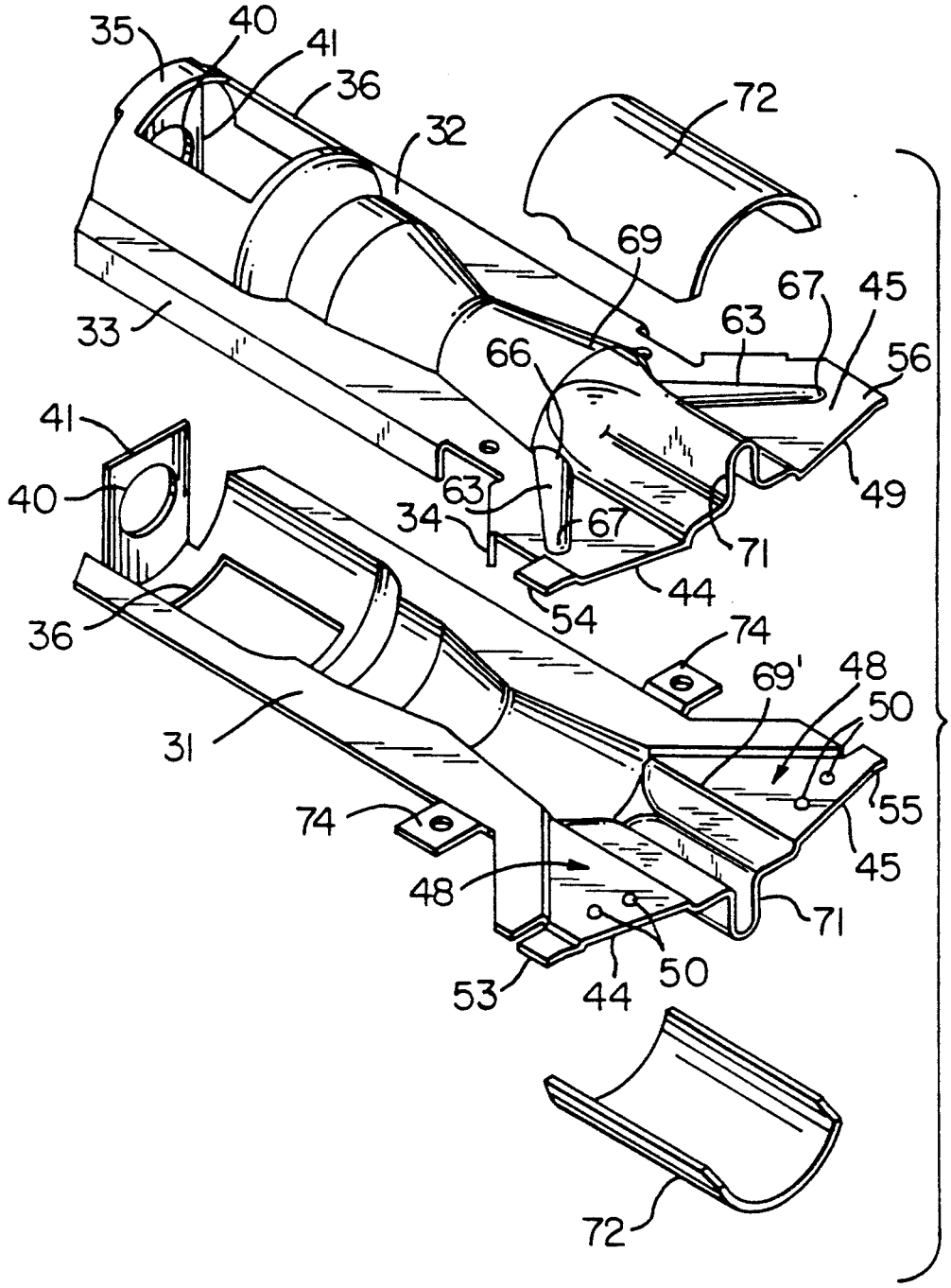
FIG. 9 is an exploded perspective view of the various parts for forming the jet burner construction of FIG. 1.

The jet burner construction 20 of this invention has the burner body means 21 thereof formed from two substantially similar sheet metal plates or parts 31 and 32, FIG. 9, suitably cut, stamped and shaped in the configurations illustrated in the drawings so that when the plates or parts 31 and 32 are disposed together in face-to-face relation, flange means 33 and 34 of the plate means 32 are folded over against the plate means 31 in the manner illustrated in FIG. 6 to seal the plates 31 and 32 together whereby the two plate means 31 and 32 readily form the burner body means 21 of the burner construction 20 in a simple and effective manner.

In one working embodiment of the jet burner construction 20 of this invention, the plate means 31 and 32 are each formed from an aluminized steel strip RMS-421 that is approximately 0.035 of an inch thick, the resulting burner body means 21 being approximately 5.000 inches in length, such dimensions being substantially the same dimensions as set forth in the aforementioned U.S. patents to Riehl whereby the other dimensions set forth in such patents to Riehl will equally apply to the burner construction 20 of this invention and need not be repeated.

The inlet means 23 of the burner body means 21 defines a substantially cylindrical wall means 35 thereof that has a plurality of primary air intake openings 36 formed therethrough downstream from a substantially circular end opening 37 in which an orifice member 38 is disposed, the orifice member 38 having a threaded portion 39 threadedly disposed in openings 40 formed through integral tab means 41 of the plates 31 and 32 which are bent at right angles so as to have the openings 40 thereof disposed in overlapping aligned relation as illustrated in the drawings.

In this manner, fuel from the fuel source 24 is adapted to be directed to the orifice member 38 by a suitable conduit means 24' to issue out of an orifice 42 thereof into the chamber means 22 to mix with the primary air being drawn into the chamber means 22 through the primary air slots 36 in a manner well known in the art so that the air mixture will pass through a venturi portion 43 of the chamber means 22 before the same reaches the outlet means 25 of the chamber means 22 to issue out of the outlet opening 26 in the unique manner that is fully set forth in the aforementioned U.S. Pat. Nos. 5,035,609 and 5,131,839to Riehl.

The plates 31 and 32 that form the burner body means 21 each has a pair of wing-like extensions 44 and 45 extending outwardly therefrom in a coplaner manner so that when the formed plates 31 and 32 are secured together by the folded over flange means 33 and 34 to form the burner body means 21, the cooperating extensions 44 and 45 define wing-like extensions that are generally indicated by the reference numerals 46 and 47 and that extend from opposite sides of the burner body means 21 adjacent the outlet end means 25 thereof.

The wing-like extensions 44 and 45 of the plate 31 are each stepped outwardly of the general plane of the plate 31 as illustrated in the drawings to define a substantially triangular cavity 48 therein that will face the cooperating side 49 of the wing-like extension 44 or 45 of the plate 32 as illustrated. In addition, the wing-like extensions 44 and 45 of the plate 31 have a plurality of dimples 50 formed therein to respectively engage against the surfaces 49 of the wing-like extensions 44 and 45 of the other plate 32 so as to space the facing surfaces of the cooperating pairs of wing-like structures 44 and 45 from each other to define fuel issuing slot means 51 therebetween that respectively interconnect to the chamber means 22 and the outlet opening 26 so that fuel can issue from the slot means 51 of the wing-like extensions 46 and 47 of the burner construction 20 to define front end carry-over ignition flame means 52 as illustrated in FIG. 2 for multiple burner ignition propagation purposes in the apparatus 28 in a manner well known in the art so that only ignition structure need to be provided for one of the jet burner constructions 20 in the apparatus 28 and the other burner constructions 20 will be ignited therefrom in a series manner as is well known in the art.

However, in order to prevent delayed ignition due to poor alignment of the burner constructions 20, the wing-like extension 44 of the plate 31 and the wing-like extension 44 of the plate 32 of each burner body means 21 are respectively provided with tabs 53 and 54 which are disposed or stepped out of the plane of the respective wing-like extensions 44 so as to provide the overlapping linked arrangement with the respective non-stepped tabs 55 and 56 illustrated in FIG. 2 of the adjacent burner constructions 20 when the jet burner constructions 20 are arranged in an aligned relation as illustrated.

Figure 7:
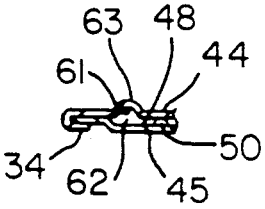
FIG. 7 is a fragmentary cross-sectional view taken on line 7—7 of FIG. 6.
Figure 8:
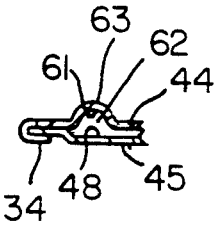
FIG. 8 is a fragmentary cross-sectional view taken on line 8—8 of FIG. 6.

The slots 51 in the wing-like extensions 46 and 47 of the burner construction 20 extend respectively along the entire respective leading edge means 57 and 58 thereof as illustrated in FIG. 2 and through which the carry-over flames 52 can issue as the same are being fed fuel from the chamber means 22 at a point downstream from the venturi section 43 and then out between spaced edge means 59 and 60 of the respective wing-like sections 46 and 47 as illustrated in FIGS. 4, 7 and 8.

When forming the plate means 32 of the burner construction 21 of this invention, the side 49 of the wing-like extensions 44 and 45 are each formed with a unique cavity 61, FIGS. 7 and 8, that faces the cavity 48 on the cooperating wing-like extensions 44 or 45 of the other plate means 31 to assure that sufficient fuel is provided for the outer ends 51' of the elongated slot means 51 for providing the carry-over flame means 52 at those outer ends 51'.

Thus it can be seen that the cavities 48 in the wing-like extensions 44 and 45 of the plate means 31 cooperate with the majority of the surface means 49 of the wing-like extensions 44 and 45 of the plate means 32 to define chambers 62 therebetween, each chamber 62 having a height that is substantially the same as the height of the respective elongated slot means 51 except for a section 63 thereof that is defined by the cavity 61 in the respective wing-like extension 44 or 45 of the plate means 32 which has a height greater than the height of the chamber means 62 outboard of that cavity 61.

The cavities 61 each has a longitudinal axis 64 that is angled relative to a longitudinal axis 65 of the burner body means 21 with each section 63 having an inner end 66 and an outer end 67, the inner end 66 being in full communication with the chamber means 22 of the burner body means 21 while the outer end 67 of the respective cavity 61 terminates short of the outer free end 68 of its respective wing-like extension 46 or 47 of the burner construction 20. In addition, it can be seen that each cavity 61 tapers from its enlarged end 66 to its smaller closed end 67 and is arcuate in transverse cross section throughout the axial length thereof as illustrated respectively by FIGS. 7 and 8.

Of course, it is to be understood that each cavity 61 of this invention can have any desired configuration and be formed by any arrangement of cavities in the respective cooperating wing-like extensions 44 and 45 of the plate means 31 and 32 to accomplish the desired features of this invention, i.e., to provide sufficient fuel to the outer areas 51' of the slot means 51 as the remainder portion of the chambers 62 that receive fuel from the chamber means 22 throughout the cooperating edge means 69' of the cavities 48 provide sufficient fuel to the inner areas of the slot means 51 for the reasons fully set forth in the aforementioned U.S. Pat. No. 5,035,609, to Riehl.

While it is believed that the chambers 62 and sections 63 thereof can have any suitable dimensions, one working embodiment thereof that is based on the dimensions previously set forth has a height of approximately 0.042 of an inch at the slot means 51 of the burner construction 20 as well as throughout substantially the entire area of the chamber means 62 whereas the height of each section 63 adjacent the smaller end 67 of the cavity 61 is approximately 0.090 of an inch and the height of the section 63 adjacent the other and larger end 66 of the cavity 61 is approximately 0.112 of an inch, each cavity 61 being defined by a radius at each transverse cross-sectional configuration thereof and being slightly longer than approximately 1.000 inch in length along the axial axis 64 thereof. For example, each cavity 61 in such working embodiment is defined by a radius of approximately 0.049 of an inch adjacent the end 67 thereof and by a radius of approximately 0.070 of an inch adjacent the end 66 thereof. The axis 64 of each cavity 61 in such working embodiment is disposed approximately 45° relative to the longitudinal axis 65 of the burner construction 20.

Thus, it can be seen that the sections 63 of the wing-like extensions 46 and 47 of the burner construction 20 uniquely supply sufficient fuel to the outer end portions 51' of the outlet slots 51 for full flame propagation purposes during the use of the burner construction 20 as previously described for the apparatus 28.

The outlet end means 25 of the burner body means 21 has its wall means 69 defining a substantially clyindrical portion 70 at one end thereof and a plurality of fluted portions 71 at the outlet end 26 thereof, each flute 71 comprising a substantially U-shaped portion and cooperating with flame shield members 72 attached to the plates 31 and 32 in any suitable manner, such as by spot welding or the like, to control the flame means 27 issuing out of the outlet end 26 of the burner body means 21 all in the manner fully disclosed and claimed in the aforementioned U.S. Pat. No. 5,035,609, to Riehl, whereby a further discussion of the fluting 71 and the flame shield means 72 need not be further described for the burner construction 20 of this invention.

However, it is to be understood that an integral flame shield arrangement could be provided in place of the separate flame shield members 72 if desired.

Figure 11:
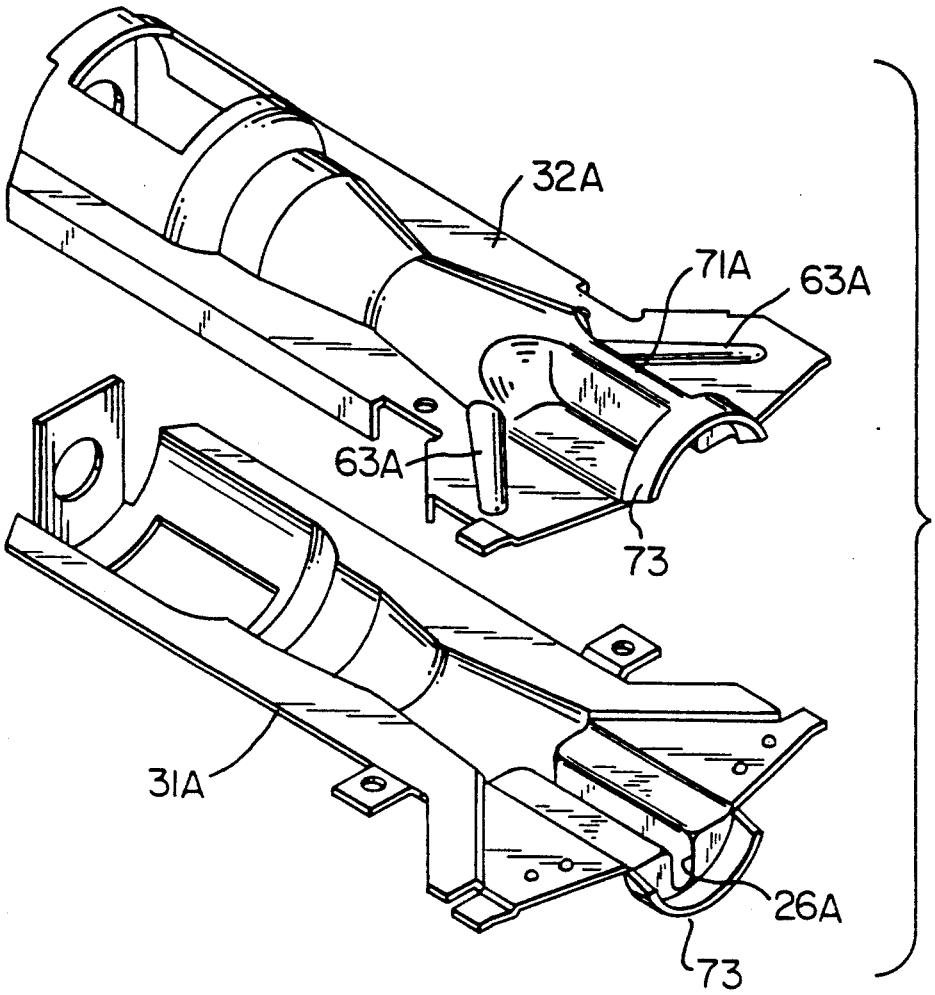
FIG. 11 is an exploded perspective view of the various parts for forming the jet burner construction of FIG. 10.
Figure 10:
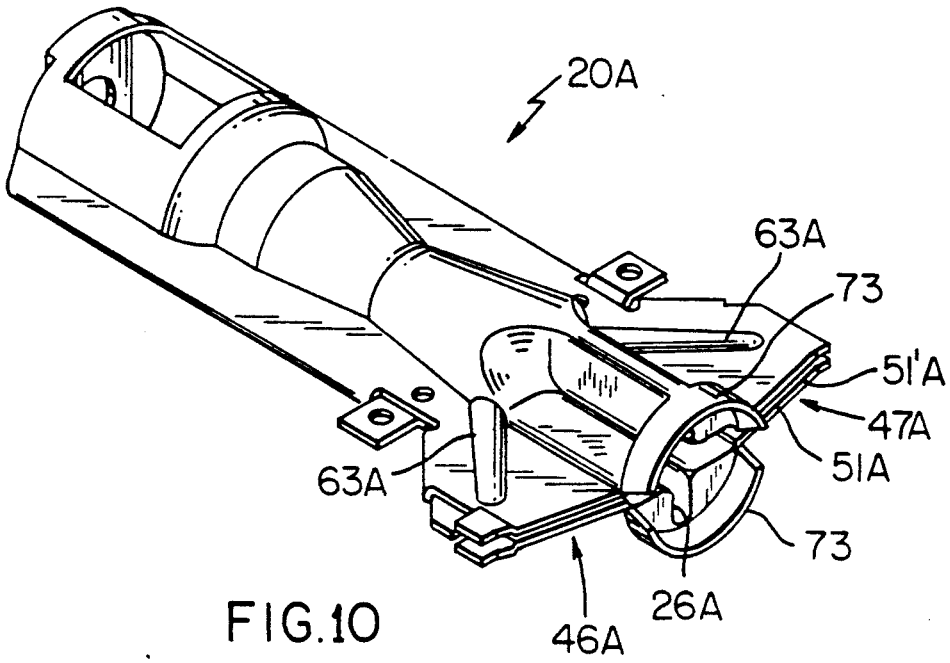
FIG. 10 is a perspective view of another new jet burner construction of this invention.

For example, another burner construction of this invention is generally indicated by the reference numeral 20A in FIGS. 10 and 11 and parts thereof similar to the parts of the burner construction 20 previously described are indicated by like reference numerals followed by the reference letter "A".

As illustrated in FIGS. 10 and 11, it can be seen that the burner construction 20A is formed from plate means 31A and 32A which are constructed the same as the plate means 31 and 32 previously described except that the same respectively have arcuate members 73 extending beyond the flutes 71A thereof to cooperate together to define a flame shield means extending beyond the outlet means 26A thereof for flame control purposes in substantially the same manner as the separate sections 72 previously described.

However, it can be seen that the burner construction 20A has the cavity defining sections 63A on the wing-like extensions 46A and 47A thereof to provide fuel to the outer portions 51'A of the slots 51A thereof for the reasons previously set forth for the cavity defining sections 63 of the burner construction 20.

Therefore, it can be seen that it is a relatively simple method of this invention to form the jet burner construction 20 or 20A of this invention that is adapted to operate in a manner now to be described.

As previously stated, once the jet burner construction 20 has been properly mounted in any suitable apparatus, such as by utilizing mounting tabs 74 of the plate means 31 in the heating apparatus 28 illustrated in FIG. 2, fuel is adapted to be directed into the chamber means 22 of that burner construction 20 through the conduit means 24' leading from the fuel source 24 so that the same will draw primary air through the openings 26 into the chamber means 22 and pass through the venturi means 43 to issue out of the outlet end means 15 at the outlet opening means 26 thereof into the four flow paths provided by the flutes 71 of the opening 26 to combine with the fuel issuing out of the central part of the opening 26 in a turbulent manner that can be ignited by any suitable ignition means so that the resulting flame means 27 will be directed into the inlet 29 of its respective heat exchanger tube 30 to have heat extracted therefrom in a manner well known in the art, the jet burner construction 20 creating the propagating side flame means 52 along the wing-like extensions 46 and 47 thereof for igniting the issuing fuel from adjacent burner constructions 20 in the manner previously set forth.

As previously stated, the sections 63 of the chambers 62 of the wing-like extensions 46 and 47 of the burner construction 20 supply sufficient fuel to the outer portions 51' of the slot means 51 thereof to create sufficient carryover flame means 52 adjacent the outer ends 68 of the wing-like extensions 46 and 47 for the reasons previously set forth.

Therefore, it can be seen that this invention not only provides a new jet burner construction and a new method of making the same, but also this invention provides a new heating apparatus utilizing such a jet burner construction and a new method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said chamber means of said burner means having a longitudinal axis extending from said inlet means to said outlet means and having a maximum height at said longitudinal axis thereof, said burner body means having wing-like extensions respectively disposed on opposite sides thereof for respectively interconnecting with adjacent wing-like extensions of adjacent burner constructions, said wing-like extensions each having a side edge means and an elongated outlet slot means extending along said side edge means thereof and interconnecting with said outlet opening means and through which fuel is adapted to issue so as to burn external to said wing-like extensions, each said slot means having a certain height throughout the elongated length thereof that is less than said height of said chamber means, each said wing-like extension having a chamber therein that has a portion thereof of a certain length that interconnects with said chamber means of said body means throughout the entire said certain length of said portion and is adapted to feed fuel from said chamber means to the respective said slot means thereof along a major portion of said elongated length thereof, each said chamber having a height throughout the entire area thereof that is substantially the same as said certain height of its respective slot means except for a section thereof that has a height thereof that is greater than said certain height and less than said maximum height of said chamber means, the improvement wherein each said section has opposed ends one of which is interconnected to said chamber means at only a minor part of said certain length of said portion and the other of which terminates short of its respective slot means, each said section having a longitudinal axis that extends between said ends thereof and that is disposed at an acute angle relative to said longitudinal axis of said chamber means so that part of said chamber of said certain height is included in said acute angle between said longitudinal axis of said section and the longitudinal axis of said chamber means.

2. A jet burner construction as set forth in claim 1 wherein the height of each said section decreases from said one end thereof to said other end thereof.

3. A jet burner construction as set forth in claim 1 wherein each said wing-like extension has a free end remote from said burner body means, each said section having its said other end adjacent said free end of its respective wing-like extension.

4. A jet burner construction as set forth in claim 1 wherein said burner body means is formed from two generally similar integral and one-piece burner body parts secured together in superimposed relation and each generally having one-half of said outlet opening means and one-half of each said wing-like extension thereon.

5. A jet burner construction as set forth in claim 4 wherein each said section comprises a cavity formed in each said one-half of each said wing-like extension of one of said burner body parts that faces the other of said burner body parts.

6. A jet burner construction as set forth in claim 5 wherein said cavities of said one of said burner body parts also define substantially the entire areas of said chambers.

7. A jet burner construction as set forth in claim 5 wherein each said cavity of said one of said burner body parts defines the outline configuration of its respective section.

8. A jet burner construction as set forth in claim 7 wherein each said cavity of said one of said burner body parts defines a generally semicircular transverse cross-sectional configuration in its respective one-half of said wing-like extension.

9. In a heating apparatus comprising a heating tube means provided with an inlet and a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means and enter said heating tube means through said inlet thereof, said chamber means of said burner means having a longitudinal axis extending from said inlet means to said outlet means and having a maximum height at said longitudinal axis thereof, said burner body means having wing-like extensions respectively disposed on opposite sides thereof for respectively interconnecting with adjacent wing-like extensions of adjacent burner constructions, said wing-like extensions each having a side edge means and an elongated outlet slot means extending along said side edge means thereof and interconnecting with said outlet opening means and through which fuel is adapted to issue so as to burn external to said wing-like extensions, each said slot means having a certain height throughout the elongated length thereof that is less than said height of said chamber means, each said wing-like extension having a chamber therein that has a portion thereof of a certain length that interconnects with said chamber means of said body means throughout the entire said certain length of said portion and is adapted to feed fuel from said chamber means to the respective said slot means thereof along a major portion of said elongated length thereof, each said chamber having a height throughout the entire area thereof that is substantially the same as said certain height of its respective slot means except for a section thereof that has a height thereof that is greater than said certain height and less than said maximum height of said chamber means, the improvement wherein each said section has opposed ends one of which is interconnected to said chamber means at only a minor part of said certain length of said portion and the other of which terminates short of its respective slot means, each said section having a longitudinal axis that extends between said ends thereof and that is disposed at an acute angle relative to said longitudinal axis of said chamber means so that part of said chamber of said certain height is included in said acute angle between said longitudinal axis of said section and the longitudinal axis of said chamber means.

10. A heating apparatus as set forth in claim 9 wherein the height of each said section decreases from said one end thereof to said other end thereof.

11. A heating apparatus as set forth in claim 9 wherein each said wing-like extension has a free end remote from said burner body means, each said section having its said other end adjacent said free end of its respective wing-like extension.

12. A heating apparatus as set forth in claim 9 wherein said burner body means is formed from two generally similar integral and one-piece burner body parts secured together in superimposed relation and each generally having one-half of said outlet opening means and one-half of each said wing-like extension thereon.

13. A heating apparatus as set forth in claim 12 wherein each said section comprises a cavity formed in each said one-half of each said wing-like extension of one of said burner body parts that faces the other of said burner body parts.

14. A heating apparatus as set forth in claim 13 wherein said cavities of said one of said burner body parts also define substantially the entire areas of said chambers.

15. A heating apparatus as set forth in claim 13 wherein each said cavity of said one of said burner body parts defines the outline configuration of its respective section.

16. A heating apparatus as set forth in claim 15 wherein each said cavity of said one of said burner body parts defines a generally semicircular transverse cross-sectional configuration in its respective one-half of said wing-like extension.

17. In a method of making a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said chamber means of said burner means having a longitudinal axis extending from said inlet means to said outlet means and having a maximum height at said longitudinal axis thereof, said burner body means having wing-like extensions respectively disposed on opposite sides thereof for respectively interconnecting with adjacent wing-like extensions of adjacent burner constructions, said wing-like extensions each having a side edge means and an elongated outlet slot means extending along said side edge means thereof and interconnecting with said outlet opening means and through which fuel is adapted to issue so as to burn external to said wing-like extensions, each said slot means having a certain height throughout the elongated length thereof that is less than said height of said chamber means, each said wing-like extension having a chamber therein that has a portion thereof a certain length that interconnects with said chamber means throughout the entire said certain length of said portion of said body means and is adapted to feed fuel from said chamber means to the respective said slot means thereof along a major portion of said elongated length thereof, each said chamber having a height throughout the entire area thereof that is substantially the same as said certain height of its respective slot means except for a section thereof that has a height thereof that is greater than said certain height and less than said maximum height of said chamber means, the improvement comprising the step of forming each said section to have opposed ends one of which is interconnected to said chamber means at only a minor part of said certain length of said portion and the other of which terminates short of its respective slot means, each said section having a longitudinal axis that extends between said ends thereof and that is disposed at an acute angle relative to said longitudinal axis of said chamber means so that part of said chamber of said certain height is included in said acute angle between said longitudinal axis of said section and the longitudinal axis of said chamber means.

18. In a method of making a heating apparatus comprising a heating tube means provided with an inlet and a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means and enter said heating tube means through said inlet thereof, said chamber means of said burner means having a longitudinal axis extending from said inlet means to said outlet means and having a maximum height at said longitudinal axis thereof, said burner body means having wing-like extensions respectively disposed on opposite sides thereof for respectively interconnecting with adjacent wing-like extensions of adjacent burner constructions, said wing-like extensions each having a side edge means and an elongated outlet slot means extending along said side edge means thereof and interconnecting with said outlet opening means and through which fuel is adapted to issue so as to burn external to said wing-like extensions, each said slot means having a certain height throughout the elongated length thereof that is less than said height of said chamber means, each said wing-like extension having a chamber therein that has a portion thereof of a certain length that interconnects with said chamber means of said body means throughout the entire said certain length of said portion and is adapted to feed fuel from said chamber means to the respective said slot means thereof along a major portion of said elongated length thereof, each said chamber having a height throughout the entire area thereof that is substantially the same as said certain height of its respective slot means except for a section thereof that has a height thereof that is greater than said certain height and less than said maximum height of said chamber means, the improvement comprising the step of forming each said section to have opposed ends one of which is interconnected to said chamber means at only a minor part of said certain length of said portion and the other of which terminates short of its respective slot means. each said section having a longitudinal axis that extends between said ends thereof and that is disposed at an acute angle relative to said longitudinal axis of said chamber means so that part of said chamber of said certain height is included in said acute angle between said longitudinal axis of said section and the longitudinal axis of said chamber means.

* * * * *